United States Patent [19]

Omori et al.

[11] Patent Number: 4,907,393

[45] Date of Patent: Mar. 13, 1990

[54] PACKAGING METHOD AND APPARATUS

[75] Inventors: Shozo Omori, Bunkyo; Takeshi Sekiguchi, Hino, both of Japan

[73] Assignees: Omori Machinery Co., Ltd., Saitama; Mitsubishi Gas Chemical Company, Inc., Tokyo, both of Japan

[21] Appl. No.: 253,865

[22] Filed: Oct. 5, 1988

[30] Foreign Application Priority Data

Oct. 16, 1988 [JP] Japan ..... 62-259475

[51] Int. Cl.[4] ..... B65B 1/04; B65B 9/06; B65B 61/20

[52] U.S. Cl. ..... 53/410; 53/128; 53/238; 53/450; 53/474; 53/550

[58] Field of Search ..... 53/128, 137, 238, 410, 53/415, 450, 474, 550; 156/519, 520; 493/188, 210, 220, 222, 223, 224, 302, 961, 994

[56] References Cited

U.S. PATENT DOCUMENTS

| | | | |
|---|---|---|---|
| 2,259,866 | 10/1941 | Stokes | 53/415 |
| 2,294,220 | 8/1942 | Albertson | 53/415 |
| 3,381,442 | 5/1968 | Paxton | 53/551 X |
| 4,083,737 | 4/1978 | Foot, Jr. et al. | 156/73.1 |
| 4,555,299 | 11/1985 | Voltmer et al. | 156/361 X |
| 4,636,276 | 1/1987 | Nozaka | 156/584 X |
| 4,642,085 | 2/1987 | Helm | 493/223 X |
| 4,726,171 | 2/1988 | Kreager et al. | 53/410 |

FOREIGN PATENT DOCUMENTS 2344359 1/1975 Fed. Rep. of Germany .

*Primary Examiner*—John Sipos
*Assistant Examiner*—Beth Bianca
*Attorney, Agent, or Firm*—Wenderoth, Lind & Ponack

[57] ABSTRACT

A packaging method includes the steps of supplying auxiliary bags, adding an adhesive layer to one of the surfaces of each auxiliary bag, feeding a continuous sheet-like wrapping material to a forming and filling assembly, attaching the auxiliary bags by the adhesive layer to the wrapping material during travel thereof, at an interval corresponding to a length required for forming each package and each at a portion thereof which becomes an inner surface of the package other than sealed portions thereof, forming the wrapping material into a tubular shape with the auxiliary bags inside, supplying articles into the tubular wrapping material and sealing the same to form the packages.

20 Claims, 3 Drawing Sheets

Prior Art FIG. 1
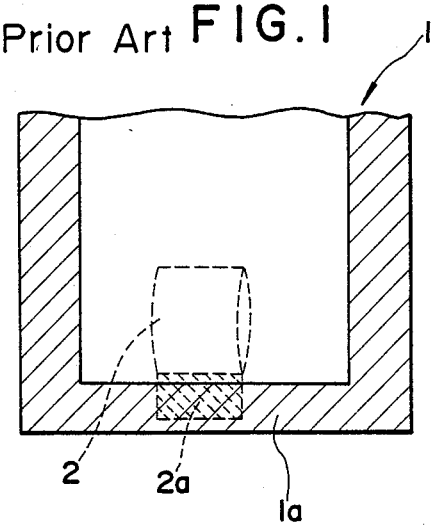
FIG. 3
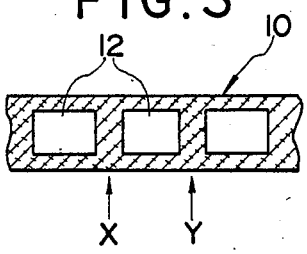
FIG. 4
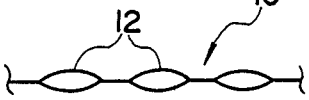
FIG. 5
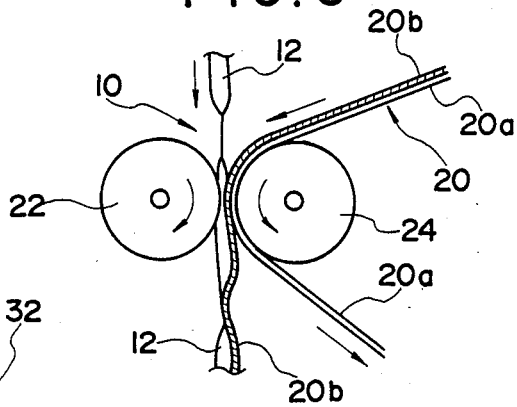
FIG. 6
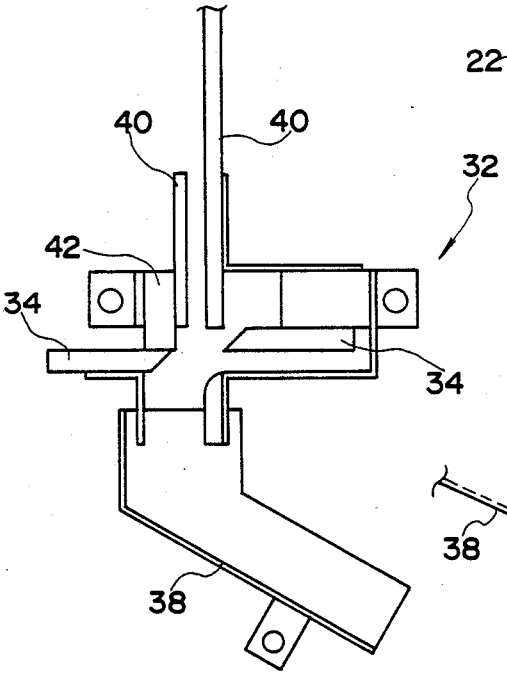
FIG. 7
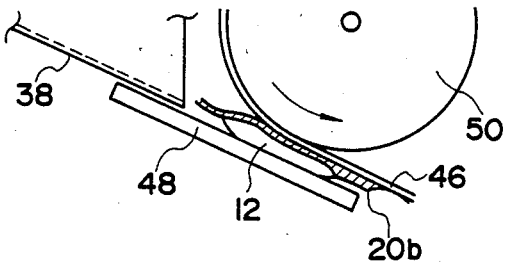

PACKAGING METHOD AND APPARATUS

BACKGROUND OF THE INVENTION

1. Field of the Invention

The present invention relates to packaging method and apparatus of the form-fill type and, more particularly, to a packaging system to pack articles together with inedible agents such as a deoxidizing agent and desiccant for preventing deterioration of the articles, typically foodstuffs.

2. Description of the Prior Art

There is an ever-increasing demand in the market for pouch packaged food products, typical examples of which are precooked noodles and coffee beans. Recently, some of these packaged products, precooked noodles for example, accompany a deoxidizing agent contained in a small bag in order to prevent oxidization of the foodstuff, together with other small bags containing condiments, garnishes etc. This small bag containing the deoxidizing agent has a shape and dimension very similar to those of the other small bags and usually no attention is paid to prevent a consumer from taking it out of the package, resulting in a possibility that the consumer erroneously mixes the agent with the other edible materials during cooking which might be followed by an accidental ingestion of the agent. Also, coffee beans are sometimes packed together with a desiccant and/or the deoxidizing agent contained in a small bag which is usually taken out of the package with the beans. Thus, a similar problem may arise if the coffee beans are supplied into a grinder directly from the package.

The accidental ingestion of inedible agents such as a deoxidizer and a desiccant can be prevented by fixedly securing the small bag to the package so that it may be retained inside the package even when the foodstuffs are taken out. In order to achieve this there has been developed a package 1 as illustrated in FIG. 1 wherein a small bag 2 has a sealed marginal portion 2*a* secured to a bottom portion 1*a* of the package 1. In manufacture, the marginal portion 2*a* is sandwiched between the opposite edges which are then heat-sealed together to form the bottom portion 1*a* of the package. In other words, the sealed portion which the package inherently has is utilized to hold the small bag. However, this prior art arrangement requires that the small bag has an extra dimension to provide the marginal portion 2*a*, and that the marginal portion be subjected to a surface treatment so as to be heat-sealable with the bottom portion 1*a*. Further, the marginal portion 2*a* sandwiched between the bottom edges creates bulges in the outer surfaces of the portion 1*a* and does not permit a pressure to be uniformly applied to the portion 1*a* during the sealing operation thereof, resulting in an unsatisfactory sealing effect with generation of pinholes in the portion 1*a*. Such inferior seal is fatal to packages containing foodstuffs.

Accordingly, an object of the present invention is to provide a packaging method which makes it possible to fix a small auxiliary bag containing inedible agents to the inside of a package without lowering the sealing effect of the package.

Another object of the invention is to provide a packaging method which permits an efficient packaging operation while automatically attaching the auxiliary bag to each package.

A further object of the invention is to provide a packaging method which requires only minimum alterations to a conventional packaging machine of the form-fill type.

A still further object of the invention is to provide a packaging apparatus for implementing the above method which is simple in structure and reliable in operation.

SUMMARY OF THE INVENTION

According to the invention, a packaging method includes the steps of supplying auxiliary bags and adding an adhesive layer to one of the surfaces of each auxiliary bag. A continuous sheet-like wrapping material of thermoplastic is fed to a forming and filling means, and the auxiliary bags are attached by the adhesive layer to the wrapping material before it reaches the forming and filling means. These bags are attached at an interval corresponding to a length of the wrapping material required for forming each package and each at a portion which becomes an inner surface of the package other than sealed portions thereof. The wrapping material is then formed into a tubular shape with the auxiliary bags inside. The tubular shaped wrapping material is, after being filled with articles, sealed to provide the packages.

In one embodiment of the invention, the auxiliary bags are first supplied in the form of a continuous strip which, after having added thereto the adhesive layer, is cut into individual auxiliary bags. The adhesive layer is provided by adhering a double coated adhesive tape to one of the surfaces of the strip.

Also, a packaging apparatus according to the invention includes means for providing individual auxiliary bags each having an adhesive layer on one of the surfaces thereof and means for feeding a continuous sheet-like thermoplastic wrapping material. An attaching means is provided to attach the auxiliary bags by the adhesive layer thereof to the wrapping material at an interval corresponding to a length of the wrapping material required for forming each package and each at a portion which becomes an inner surface of the package other than sealed portions thereof. The apparatus also includes means for forming the wrapping material into a tubular shape with the auxiliary bags inside, supplying articles into the tubular wrapping material and for sealing the tubular wrapping material to provide the packages.

The "auxiliary bag" referred to herein means a bag sufficiently smaller than the package to contain an inedible agent for preventing deterioration of the article, typically foodstuffs. In case the foodstuffs are to be packed, the adhesive layer is formed by an adhesive material which is suitable for use in connection with the foodstuffs.

Because the auxiliary bag is attached to the wrapping material from which the package is formed, it may be retained inside the package after the article is taken out to prevent any accidental ingestion of the inedible agents. Further, since the auxiliary bag is adhered to the package at a portion thereof other than the sealed portions thereof, the package can be completely sealed.

Other objects, features and advantages of the invention will be apparent from the following description of preferred embodiments thereof when taken in conjunction with the accompanying drawings.

BRIEF DESCRIPTION OF THE DRAWINGS

FIG. 1 is a schematic view illustrating a prior art package having an auxiliary bag;

FIG. 3 is a plan view showing a strip of auxiliary bags used in/the embodiment;

FIG. 4 is a side view of the strip of FIG. 3;

FIG. 5 is a side view showing provision of an adhesive layer on the strip;

FIG. 6 is a side view showing a cutting assembly and a chute;

FIG. 7 is a side view showing attachment of the auxiliary bag to a wrapping material;

DESCRIPTION OF THE PREFERRED EMBODIMENTS

Figure 2:
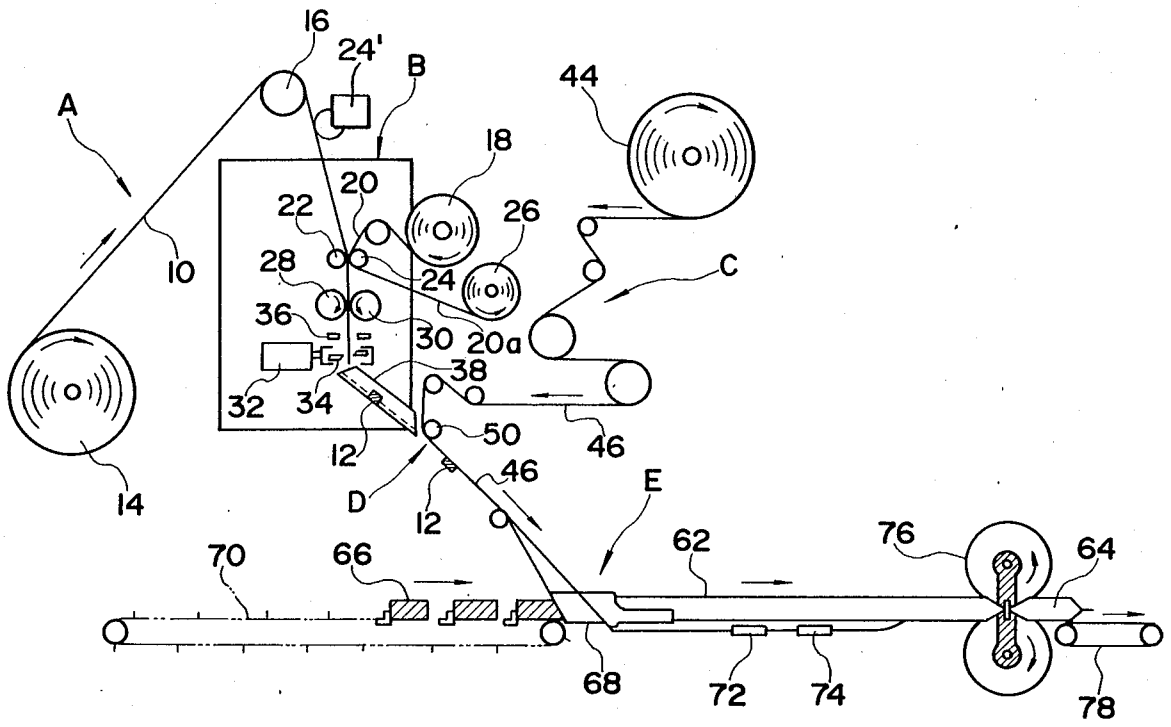
FIG. 2 is a schematic representation of a packaging apparatus according to an embodiment of the present invention.

Referring first to FIG. 2 of the drawings, there is illustrated a packaging machine particularly suitable for use in connection with foodstuffs. The machine generally includes in succession supply means A for feeding a strip 10, adhesive layer adding and strip cutting means B, wrapping material feed means C, auxiliary bag attaching means D, and forming and filling means E. In the illustrated embodiment, the forming and filling means E is of a pillow type to produce a final package (see FIGS. 9 and 10).

As shown in FIGS. 3 and 4, the strip 10 is constituted by small auxiliary bags 12 arranged at regular intervals along the longitudinal direction of the strip 10. Each auxiliary bag 12 contains inedible agents such as a deoxidizer, desiccant etc. for preventing deterioration of foodstuffs, condiments, garnishes etc. that are to be filled in the final package. The supply means A comprises a feed roll 14 on which the strip 10 is wound and a guide roll 16 over which the strip 10 from the feed roll 14 is fed into the succeeding unit B.

The adhesive layer adding and strip cutting means B is adapted to add an adhesive layer on one of the surfaces of the strip 10 and to cut the strip 10 into individual auxiliary bags 12. It includes a feed roll 18 for supplying a double coated adhesive tape 20 to a path of the strip 10 defined by an idle roller 22 and a pressure roller 24 facing each other. The adhesive tape 20 is selected to be suitable for use in connection with foodstuffs and has on one surface a release liner **20*a* which is taken up by a drum 26. A pair of driven rollers 28 and 30 are provided downstream of the rollers 22, 24 for advancing the strip 10 to a cutting assembly 32 having a pair of opposite blades 34. A sensor 36 is disposed between the driven rollers and cutting assembly and detects positions on the strip 10 at which it is to be cut. The cutting assembly 32 is followed by a chute 38 which transfers the individually cut auxiliary bags 12** to the next unit D.

Referring now to FIG. 5, the tape 20 having an adhesive layer **20*b* is guided by the pressure roller 24 into the path of the strip 10 where the tape 20 is superposed on the strip 10 under a predetermined pressure (of such a degree as will not break the auxiliary bags 12) exerted by the roller 24 in cooperation with the idle roller 22. As a result, the adhesive layer 20*b* of the tape 20 transfers by adhesion to one of the surfaces (which will later come into contact with a wrapping material) of the strip 10 so that the strip 10, after passing through the rollers 22 and 24, carries the adhesive layer 20*b*. The liner 20*a* is released from the layer 20*b* attached to the strip 10 and is taken up by the drum 26**.

The strip 10 thus provided with the adhesive layer **20*b* is advanced to the cutting assembly by the rollers 28 and 30. At least the roller 30, which contacts the adhesive layer 20*b*, has been subjected to a surface treatment for preventing the layer 20*b* from adhering thereto. Prior to the strip 10 entering into the cutting assembly 32, the sensor 36 detects the positions on the strip 10, such as X and Y in FIG. 3, and sends signals to control means (not shown) so that the blades 34 cut the strip 10 at the detected positions into individual auxiliary bags 12 having the adhesive layer 20*b*. As shown in FIG. 6, the assembly 32 includes a pair of guide plates 40 through which the strip 10 is fed into the cutting station. The cutting operation is achieved by moving the left-hand blade 34 in such a manner that its upper surface slides o the lower surface of the right-hand blade 34. A remover 42 formed of felt or the like is provided to abut against the upper surface of the movable blade 34 and removes from the blade any adhesive material which may become attached thereto when cutting the strip 10. The upper end of the chute 38 is so secured to the assembly 32 that the individual auxiliary bags 12 are guided into the chute 38 with the adhesive layer 20*b*** being directed upwardly.

Referring again to FIG. 2, the wrapping material feed means C comprises a feed roll 44 to which a sheet-like wrapping material, i.e. a thermoplastic film 46 in the embodiment, is wound and a plurality of rollers for guiding the wrapping film 46 to the attaching unit D. The film 46 is of usual type that is used to wrap articles such as foodstuffs.

The attaching means D is adapted to attach each auxiliary bag 12, by using the adhesive layer **20*b* to the film 46 at a position which will become an inner surface of a package except its seal margins. As best shown in FIG. 7, the attaching means includes a rubber plate 48 which extends below the chute 38 and beyond the outlet thereof to receive each auxiliary bag 12, and a support roller 50 facing the rubber plate 48 with a space therebetween that is adjusted so as to permit the auxiliary bags 12 to pass through such space under pressure. The support roller 50 guides the wrapping film 46 to the forming and filling means E. Accordingly, the film 46 comes into contact with the adhesive layer 20*b* of the auxiliary bag 12 and, after the roller 50, it travels with the bags 12** attached thereto.

Figure 9:
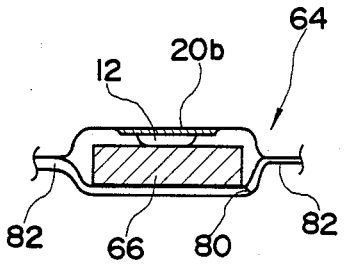
FIG. 9 is a cross-sectional view of a package (finished product) manufactured by the apparatus of FIG. 2.
Figure 10:
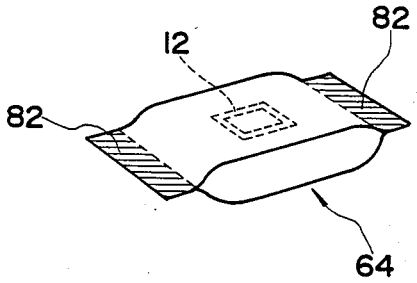
FIG. 10 is a perspective view of the package.

It is to be noted here that the timing at which the auxiliary bags 12 are supplied to the path of the film 46 is synchronized with the film traveling speed so that the bags 12 may be attached to the film at an interval corresponding to a film length required for making each package. More particularly, the auxiliary bag supply timing is such that each bag 12 is attached to the respective package at a position other than the seal margins thereof, as illustrated in FIGS. 9 and 10.

Figure 8:
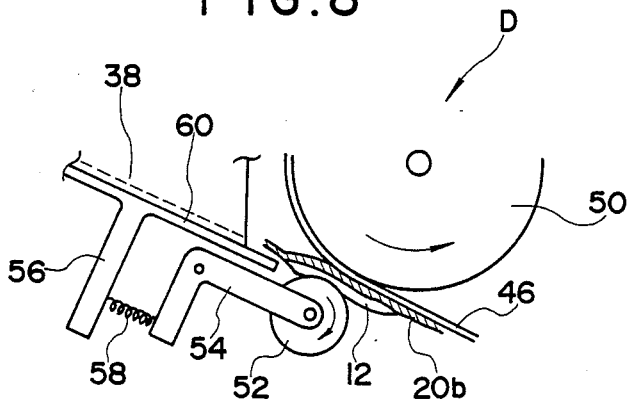
FIG. 8 is a similar view showing another example of attachment.

A modified structure of the attaching means D is illustrated in FIG. 8 and has a pressure roller 52 instead of the rubber plate 48 of FIG. 7. This pressure roller 52 is rotatably secured to one end of an L-shaped swing lever 54 which is pivotted at its corner and is connected at the other end to a stationary member 56 by a compression spring 58. The stationary member 56 has an elongated portion 60 fixed to the underside of the chute 38 to project from the outlet thereof for guiding the auxiliary bag 12 into a path defined between the pressure roller 52 and the support roller 50. Because the compression spring 58 urges the pressure roller 52 toward the support roller 50, each auxiliary bag 12 from the chute 38 is adhered to the film 46 be the layer **20*b* when passing through the space between rollers 50, 52**.

The forming and filling means E is of the known pillow type whereby the film 46 is formed into a continuous tube 62 which is sealed and cut into individual packages 64 after being filled with articles 66 such as foodstuffs. The film 46 from the attaching means D is advanced to a former 68 where it is formed into a tubular shape by overlapping the opposite longitudinal edges of the film 46 together with the surface to which the auxiliary bags 12 are attached being inside.

In the illustrated embodiment, the overlapped edges are situated at a center of the lower side of the tube 62 while the auxiliary bags 12 are on the upper side. A chain conveyor 70 is provided to convey the articles 66 at a predetermined pitch and to transfer an article into the film tube 62 each time the film advances a distance for one package. The film tube 62 containing the articles 66 is forwarded through a device 72 typically comprising a pair of driven rollers to a center sealer 74 where the overlapped longitudinal edges are heat-sealed together. The film tube 62 is then sealed along a direction transverse to its direction of travel, at a predetermined pitch, by an end sealer assembly 76 which also cuts the film tube at the sealed portions to produce the individual packages 64. A discharge conveyor 78 is provided adjacent the end sealer assembly 76 for carrying away the packages 64.

It should be noted here that the entire mechanisms of the above machine ar automatically controlled by the control means (not shown).

The individual package 64, i.e. the final product, is illustrated in FIGS. 9 and 10 wherein the center-sealed portion is indicated by numeral 80 and the end-sealed portions by 82. As described hereinbefore, the auxiliary bags 12 are attached to the film 46 exactly at the predetermined positions such that each package 64 has one auxiliary bag 12 attached through the adhesive layer **20*b* to the inner surface of the package at a position other than the sealed portions 80 and 82. Accordingly, the auxiliary bag 12 is prevented from being discharged out of the package 64 when the article 66 is removed therefrom. This enables consumers to avoid accidental ingestion of the inedible agents contained in the auxiliary bag 12. In addition, since it is no longer necessary to hold the auxiliary bag 12 by any of the sealed portions of the package 64, as experienced in the prior art, the sealed portions 80 and 82** can be evenly pressed during the sealing operation to achieve the desired sealing effect with increased adhesion.

The machine set forth above requires minimum additions and/or alterations to the conventional pillow type packaging apparatus because a combination of the usual forming device and fill-seal device, or the usual form-fill-seal device, may be employed as the forming and sealing means E with or without slight modifications.

In the above embodiment the pillow type package has been described by way of example, and the present invention is also applicable to other types such as three-sided or four-sided seal packages. The forming and filling device may be of the horizontal type as in the above embodiment or of the vertical type.

Also, the adhesive layer on the auxiliary bag 12 may be formed in a manner other than by using the double coated adhesive tape. For example, an adhesive agent suitable for use in connection with foodstuffs can directly be coated on a surface of the strip 10 by using a spread roll and the like (see 24 in FIG. 2).

Further, use of the strip 10 of the auxiliary bags 12 is not essential. If desired, previously separated auxiliary bags can be supplied at a predetermined interval to the attaching means through the adhesive layer adding means. In that case, the sensor 36 and the cutting assembly 32 in the above embodiment can be omitted.

As it could be understood from the foregoing description, the auxiliary bag containing the inedible agents is automatically attached to the wrapping film which is then formed into the package with the auxiliary bag inside thereof. This permits an efficient manufacture of the final packages having the auxiliary bags. The article, e.g. foodstuff, may be taken out of the package by breaking any of the sealed portions as in conventional packages, with retaining the auxiliary bag in the package to thereby prevent any accidental ingestion of the inedible agents. Further, since the auxiliary bag is adhered to the inner surface of the package at a position other than the marginal portions, it is not necessary to sandwich a part of the auxiliary bag between the edges of the package to be sealed. This is advantageous because the marginal portions of the package become flat and can be sealed with a uniform pressure to prevent generation of pinholes.

Although the present invention has been described with reference to the preferred embodiments thereof, many modifications and alterations may be made within the spirit of the invention. Particularly, the invention is not limited to packing of foodstuffs but is also applicable in connection with various other articles.

What is claimed is:

1. A packaging method of forming packages, said method comprising the steps of:

supplying auxiliary bags;

adding an adhesive layer to one of the surfaces of each said auxiliary bag;

feeding a continuous sheet-like thermoplastic wrapping material to a forming and filling means;

attaching said auxiliary bags by said adhesive layer to said wrapping material, prior to said wrapping material reaching said forming and filling means, at an interval corresponding to a length of said wrapping material required for forming each package, and each said auxiliary bag being attached to a portion of said wrapping material that becomes the inner surface of the respective package other than sealed portions thereof;

said attaching step being performed by transferring each said auxiliary bag by a chute into a path of said wrapping material with said adhesive layer oriented toward said wrapping material and by attaching said auxiliary bags to said wrapping material by attaching means comprising a guide member for receiving said auxiliary bag from said chute and a support roller facing said guide member, said wrapping material being guided by said support roller to come into press-contact with said auxiliary bag;

forming said wrapping material into a tubular shape with said auxiliary bags inside;

supplying articles into said tubular shaped wrapping material; and sealing said tubular shaped wrapping material to thereby form the packages.

2. A packaging method as claimed in claim 1, wherein said auxiliary bag contains a deoxidizing agent.

3. A packaging method as claimed in claim 1, wherein said auxiliary bag contains a desiccant.

4. A packaging method as claimed in claim 1, wherein said auxiliary bags supplying step comprises feeding a continuous strip having a number of each auxiliary bags joined together, and further including the step of cutting said strip into individual said auxiliary bags after said adhesive layer adding step.

5. A packaging method as claimed in claim 4, wherein said adhesive layer adding step comprises adhering a double coated adhesive tape to one of the surfaces of said strip.

6. A packaging method as claimed in claim 5, wherein said adhesive tape adhering step comprises guiding said adhesive tape having a release liner on one side thereof into a path of said strip, pressing the other side of said adhesive tape against said one of the surfaces of said strip, and separating said release liner from said adhesive tape.

7. A packaging method as claimed in claim 4, wherein said adhesive layer adding step comprises applying an adhesive agent to one of the surfaces of said strip by coating means.

8. A packaging method as claimed in claim 1, wherein said auxiliary bags supplying step comprises sequentially feeding said auxiliary bags that are previously separated from each other, and wherein said adhesive layer adding step includes applying an adhesive agent to one of the surfaces of each said auxiliary bag by coating means.

9. A packaging apparatus for forming packages, said apparatus comprising:

means for providing individual auxiliary bags each having an adhesive layer on one of the surfaces thereof;

means for feeding a continuous sheet-like thermoplastic wrapping material;

means for attaching said auxiliary bags by said adhesive layer to said wrapping material at an interval corresponding to a length of said wrapping material required for forming each package and such that each said bag is attached to a portion of said wrapping material that becomes the inner surface of the respective package other than sealed portions thereof;

said auxiliary bag providing means including a chute for transferring each said auxiliary bag to said attaching means with said adhesive layer oriented toward said wrapping material;

said attaching means comprising a guide member for receiving each said auxiliary bag from said chute and a support roller facing said guide member, said wrapping material being guided by said support roller to come into press-contact with said auxiliary bag; and means for forming said wrapping material into a tubular shape with said auxiliary bags inside, for supplying articles into said tubular-shaped wrapping material and for sealing said tubular-shaped wrapping material to thereby form the packages.

10. A packaging apparatus as claimed in claim 9, wherein said auxiliary bag contains a deoxidizing agent.

11. A packaging apparatus as claimed in claim 9, wherein said auxiliary bag contains a desiccant.

12. A packaging apparatus as claimed in claim 9, wherein said auxiliary bags providing means comprises means for supplying a continuous strip having a number of said auxiliary bags joined together, means for adding an adhesive layer to one of the surfaces of said strip and means for cutting said strip into said individual auxiliary bags.

13. A packaging method as claimed in claim 12, wherein said adhesive layer adding means includes a feed roll for supplying a double coated adhesive tape having a release liner on one side thereof to a path of said strip, a pair of opposite rollers defining said path, said adhesive tape being guided by one of said rollers to come into press-contact at the other side thereof with said strip, and a drum for taking up said release liner from said adhesive tape.

14. A packaging apparatus as claimed in claim 12, wherein said adhesive layer adding means includes a spreader for applying an adhesive agent to said one of the surfaces of said strip.

15. A packaging apparatus as claimed in claim 12, wherein said cutting means includes a sensor for detecting cutting points of said strip and a cutting assembly having a movable blade adapted to project beyond a path of said strip.

16. A packaging apparatus as claimed in claim 15, wherein said cutting assembly further comprises a remover abutting said movable blade for removing adhesive material therefrom.

17. A packaging apparatus as claimed in claim 9, wherein said auxiliary bags providing means comprises a feeder for sequentially feeding said auxiliary bags that are previously separated from each other and a spreader for applying an adhesive agent to one of the surfaces of each said auxiliary bag.

18. A packaging apparatus as claimed in claim 9, wherein said guide member comprises a rubber plate defining in cooperation with said support roller a space slightly smaller than a thickness of said auxiliary bag.

19. A packaging apparatus as claimed in claim 9, wherein said guide member comprises a pressure roller urged toward said support roller and permitting said auxiliary bag to pass between said pressure roller and said support roller.

20. A packaging apparatus as claimed in claim 19, wherein said guide member further comprises a L-shaped swing lever, said pressure roller being secured to one end thereof, and a spring means biasing the other end of said swing lever.

* * * * *